US006407513B1

(12) United States Patent
Vollkommer et al.

(10) Patent No.: US 6,407,513 B1
(45) Date of Patent: Jun. 18, 2002

(54) GAS-DISCHARGE LAMP WITH CONTROLLABLE LENGTH OF ILLUMINATION

(75) Inventors: Frank Vollkommer, Buchendorf; Lothar Hitzschke, Munich, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/555,096

(22) PCT Filed: Sep. 13, 1999

(86) PCT No.: PCT/DE99/02898

§ 371 (c)(1),
(2), (4) Date: May 24, 2000

(87) PCT Pub. No.: WO00/19486

PCT Pub. Date: Apr. 6, 2000

(30) Foreign Application Priority Data

Sep. 29, 1998 (DE) ..... 198 44 725

(51) Int. Cl.[7] ..... H05B 41/00

(52) U.S. Cl. ..... 315/246; 315/260; 315/287; 313/607

(58) Field of Search ..... 315/246, 260, 315/287, 224; 313/497, 493, 540, 607, 631

(56) References Cited

U.S. PATENT DOCUMENTS 4,843,521 A 6/1989 Plofchan ..... 313/491
5,604,410 A * 2/1997 Vollkommer et al. ..... 315/246
5,760,541 A 6/1998 Stavely et al. ..... 362/16
6,084,360 A * 7/2000 Yokokawa et al. ..... 315/246

FOREIGN PATENT DOCUMENTS

| | | |
|---|---|---|
| DE | 196 24 046 A1 | 12/1997 |
| DE | 197 18 395 C1 | 10/1998 |
| GB | 1 424 102 | 2/1976 |
| WO | 94/23 442 | 10/1994 |
| WO | 97/04625 | 2/1997 |
| WO | 00/13204 | 3/2000 |
| WO | 00/13472 | 3/2000 |

OTHER PUBLICATIONS

Hella Lichttechnik Research & Development Review 1996, "Stop", Dr. Heinz Werner Rixen, et al., Hella KG Hueck & Co. 08/96, pp. 114–120.

Patent Abstracts of Japan, vol. 1996, No. 07, Jul. 31, 1996, & JP 08 064181 A (Matsushita Electric IND Co. LTD) Mar. 8, 1996.

Patent Abstracts of Japan, vol. 005, No. 167 (E–079), Oct. 24, 1981 & JP 56 096450 A (Matsushita Electric Works LTD), Aug. 4, 1981.

* cited by examiner

*Primary Examiner*—Don Wong
*Assistant Examiner*—Wilson Lee
(74) *Attorney, Agent, or Firm*—William E. Meyer

(57) ABSTRACT

An elongated gas-discharge lamp having a controllable illuminated length may be formed with a dielectric barrier discharge, in which the position of a discharge voltage is dependent, for example, on a discharge gap 6' which varies over the length of the lamp 1'. The varying discharge gap allows, for example, bar displays or quantitative brake warning lights to be provided.

11 Claims, 6 Drawing Sheets

GAS-DISCHARGE LAMP WITH CONTROLLABLE LENGTH OF ILLUMINATION

TECHNICAL FIELD

This invention relates to a gas-discharge lamp which makes use of a so-called dielectric barrier discharge. To this end, a discharge vessel which is at least partially transparent and filled with a gas filling has at least one anode and at least one cathode. The electrodes have a geometry in the form of strips, that is to say they are in the form of strips at least in places. However, they may also have more complex shapes, for example with branches. In the case of a dielectric barrier discharge, at least one of the electrodes, the anode for unipolar operation, must be covered with a dielectric layer.

However, in the context of this application, the terms anode and cathode should not be regarded as limiting the invention to unipolar operation. In a bipolar case, there is no difference between anodes and cathodes, so that the statements for one of the two electrode groups then apply to all electrodes.

1. Background Art

Lamps with a dielectric barrier discharge are known in the prior art, particularly for back lighting of flat screens. This application area will not be described in detail here.

With respect to a preferred embodiment of the invention described further below, reference is made, as prior art, to Hella-Lichttechnik R & D Review 1996 (08/96), page 119, and to EP 0 813 996 A2. This prior art includes the idea of improving the warning function of a brake warning light by varying the illuminated area, for example varying the illuminated length of the brake warning light.

2. Description of the Invention

This invention is based on the technical problem of extending the application options for gas-discharge lamps using a dielectric barrier discharge. According to the invention, this problem is solved by a gas-discharge lamp having a discharge vessel filled with a gas filling, having at least one anode in the form of a strip and having at least one cathode in the form of a strip, which are arranged essentially parallel to one another, at least in places, and having a dielectric layer at least between the anode and the gas filling, characterized in that in the region of its essentially parallel profile, the electrode arrangement is at least partially inhomogeneous along its length in a form which varies a maintaining voltage.

Furthermore, the invention for solving this problem relates to a method for actuating such a gas-discharge lamp having pulsed real-power injection, in which a maintaining voltage for the lamp is varied by varying at least one time parameter of the supply power.

Finally, one particular solution to this problem according to the invention results from an apparatus for indicating a braking deceleration of a motor vehicle or two-wheeled vehicle having such a lamp, a braking deceleration sensor and a control unit which is supplied with a signal from the braking deceleration sensor and actuates the lamp.

The basic idea of the invention is to design the electrode system of a lamp with a dielectric barrier discharge such that inhomogeneous discharge preconditions exist along at least a part of the length of the electrodes. In this case, the aim is to monotonically vary a maintaining voltage for the discharge in places, at least in terms of an effective mean value. This maintaining voltage may be, in particular, a minimum maintaining voltage which in this case does not correspond to the starting voltage of an individual discharge, but is the minimum voltage which allows a discharge structure to be maintained at a specific point in the electrode arrangement.

In the case of the pulsed real-power injection, which is considered in a preferred manner here, the restarting of an individual discharge in the residual ionization that still remains after one of the regular brief interruptions in the real-power injection, that is to say those brief interruptions which occur in continuous operation of the light, does not mean restarting. In fact, restarting means switching on the lamp again without the gas filling having any specific residual ionization.

A major advantage of a gas-discharge lamp with a dielectric barrier discharge over conventional gas-discharge lamps is the positive current/voltage characteristic. By virtue of the unambiguous relationship between the current and voltage, this allows a change in the supply voltage to lead to a change in the illuminated length of the gas-discharge lamp with a dielectric barrier discharge, and thus to a change in the lamp current. In conventional fluorescent lamps, this is prevented by a negative differential resistance in the current/voltage characteristics.

If the minimum maintaining voltage is now varied over a portion of the length of the electrode arrangement in the manner according to the invention, then it is possible, during operation, to control the portion of this length section with the monotonically varying minimum maintaining voltage over which discharges burn, by adjusting and varying the power supply, in particular its voltage. The illuminated length section is thus adjusted.

There are various options for the minimum maintaining voltage of such an inhomogeneous electrode arrangement to be monotonically dependent on position. A first option is to vary the distance between the electrodes that governs the discharge. The larger the gap becomes, the greater is the minimum maintaining voltage required to maintain a discharge across this distance.

On the other hand, the difference between the starting voltage and the minimum maintaining voltage can be explained in that a discharge to a specific point in the electrode arrangement with a specific gap can always start in an adjacent region with a shorter gap and can move into the region in which the available voltage is just still sufficient for the discharge. This is due to the fundamental phenomenon that the discharge structures are wherever possible distributed over the available electrode surfaces since, for a dielectric barrier discharge, the greater available area on the dieletrically coated electrode provides better high-frequency conductivity and thus a reduced voltage drop across the dielectric.

On the other hand, there are also structures in which the movement of individual discharge structures between points with a gap which is sufficiently short to start a discharge and points at which the gap is only sufficiently short to maintain a discharge that has been started at some other point is not directly possible. For example, in the case of the invention, it is possible to provide the electrodes with projections (which are known per se) for physical localization of individual discharges. These projections may be, for example, small tabs on one or both electrodes, between which the discharge is maintained. The critical distance for starting and maintaining a discharge is then the distance between the tip of such a tab and the opposite electrode, or between the tips of two opposite tabs. It is obvious that, in this case, the discharge structures cannot move continuously and a voltage which is sufficient to maintain the discharge between the projections must first of all be available for a further movement step (to the next projection) to take place. In an extreme case, the situation may thus even arise where the maintaining voltage mentioned in claim 1 corresponds to the discharge starting voltage and not to the minimum maintaining voltage. Compromises between these extreme situations are, of course, also feasible.

Furthermore, it can be seen from the example with the electrode projections that the discharge characteristics of the electrode arrangement need not necessarily be varied continuously or monotonically. However, for various applications (which will be described in more detail in the following text), the discharge characteristics should be monotonic functions of position over a certain region of the electrode arrangement at those points which always support discharges, that is to say, for example, at the tips of the projections.

A further option for varying the discharge voltage is the dependency of the anode width on position. On the one hand, the anode width influences the surface area of the anode available for the discharge, and thus the current flowing in the discharge. The discharge current in turn governs the residual ionization of the gas filling that remains at the end of a dead-time period between two real-power pulses, and this governs the probability of restarting. On the other hand, when the discharge current is distributed over a larger anode area, this results in a smaller voltage drop across the dielectric, and thus in a stronger electrical field in the gas filling.

The anode width can, of course, be varied both for essentially "smooth" electrodes and in conjunction with the described electrode projections. Furthermore, the thickness of the dielectric can also be varied, thus allowing the discharge current and the electrical field in the gas filling to be influenced in an analogous manner.

The examples explained so far relate to inhomogeneities in the electrode arrangement in order to influence a discharge voltage. In a gas-discharge lamp designed in such a way, it is thus possible to control the length sections of the electrode arrangement in which discharges are maintained, and where they are not, by varying the voltage of a power supply, for example the voltage in the real-power pulses from a pulsed power supply.

However, in such a gas-discharge lamp, it is also possible to adjust the length section where discharges occur using other electrical supply parameters. In particular, the minimum maintaining voltage of the lamp depends on specific time parameters of a supply power with pulsed real-power injection. One possible time parameter is the dead time between the real-power pulses. The longer this dead time is chosen to be, the less is the residual ionization remaining at the end of the dead time and thus the lower is the probability of restarting, or the higher is the voltage required for restarting (within continuous light operation, that is to say between separate real-power pulses.

Another possible time parameter is the time derivative of the voltage rise, that is to say the gradient of the voltage rise, at the start of a real-power pulse. Initially, this option (as, in principle, are all the inventive measures described so far, as well) is an empirical result of the development work by the inventors. One possible explanation could be that, as the voltage rise becomes steeper and the weighting of the high-frequency Fourier components of the voltage waveform becomes greater, the high-frequency conductivity of the dielectric in particular is improved and thus, as already explained, the electrical field that exists in the gas filling becomes stronger.

One preferred application of the gas-discharge lamp according to the invention is a lamp for a bar display. For this purpose, the discharge vessel has an elongated shape, for example a tubular shape, and the strip arrangement of the electrodes extends at least along a portion of the elongated shape. In this case, the already described inhomogeneity of the electrode arrangements for a bar display lamp is chosen such that the discharge voltage is position-dependent along the length of the bar display, or of a portion of it. By adjusting the voltage of the power supply or by adjusting the described time parameters, it is now possible to set the length of the bar display lamp that illuminates. Quantitative information content can thus be provided by such a bar display, for example relating to specific technical parameters for an electronic appliance or an electrical system, and conventional LED bar displays or illuminated analogue instruments can be replaced. This is of particular interest in applications in which the brightness of the display plays a significant role.

In the case of electrodes which are to some extent "smooth", the bar display is in this case virtually continuous; if the inhomogeneity has a stepped configuration or if the described projections are used, the information from the bar display can also, however, be conveyed discretely, that is to say non-continuously between different stages of illuminated lengths.

A tubular shape of the discharge vessel is also advantageous, for example, for a further application of the gas-discharge lamp according to the invention and is of particular interest. In this case, the lamp according to the invention is used as a brake warning light on a vehicle, in particular a motor vehicle or a two-wheeled vehicle. Such a brake warning light combines the warning and signalling function of a conventional brake warning light and also provides a graduated indication of the severity of the deceleration, so that traffic travelling behind can react in an appropriate manner.

For this purpose, the brake warning light is connected to a control unit, which receives a signal from a braking deceleration sensor. The braking deceleration sensor may be a dynamic deceleration sensor, for example a piezoelectric deceleration sensor. However, a kinematic device is also possible, which calculates the braking deceleration from the rate of change of the speed of travel. The speed of travel may be derived, for example, from an actuation signal for a vehicle tachometer or for an on-board computer.

A further option is indirect measurement of the braking deceleration via the braking device in the motor vehicle or two-wheeled vehicle. For example, it is possible to detect the brake pedal pressure or the contact pressure or tensile force on a brake lever. It is also particularly simple to detect the position or deflection of the brake pedal or brake lever. These indirect variants of deceleration sensors also have the advantage that they lead to the brake warning light being fully illuminated, for example when attempting hard braking on slippery ground, even though the actual physical deceleration is, possibly, rather low. This ensures an unrestricted warning function in such critical road traffic situations.

On the other hand, dynamic and kinematic (direct) deceleration sensors can lead to full response of the brake warning light in situations in which the driver scarcely operates the braking system, or does not operate it at all, for example in the event of a rear-impact collision which the driver identifies too late. Combinations of both options are, of course, also feasible, combining the corresponding advantages.

With regard to the configuration of the brake light itself, a maximum warning function is provided if this light extends essentially over the entire vehicle width, in particular of a motor vehicle. If the illuminated part becomes larger outwards to the left and right from the center of the motor vehicle as the deceleration increases, the vehicle width provides a reference length and, in normal braking manoeuvres where the response of the brake warning light is limited, this provides a direct similarity between the appearance of the third brake warning lights which are currently being introduced into road transport.

On the other hand, the complementary geometry, in which the illuminated region of the brake warning light extends increasingly from the left and right on the outside towards the center has the advantage that the distance between the outer limits of the illuminated region provides a reference scale even when visibility is poor. Traffic travelling behind can thus relate the length of the overall illuminated region to these outer limits. In the complementary case, such a reference scale is provided only if the width of the brake warning light or of the motor vehicle can be identified because the environmental brightness is sufficiently good, or from other rear lights.

In order to formulate the already mentioned elongated form of the electrode arrangement and the inhomogeneity somewhat more specifically, it is preferable in this invention for this inhomogeneity to extend along a distance which is considerably greater than the discharge gap between the relevant electrodes, if the variation of the discharge gap is considerably greater than the minimum discharge gap. In particular, this distance should in this case be longer than twice, and preferably longer than five times, the (minimum) discharge gap.

Particularly with respect to the already mentioned application areas for a bar display and a brake warning light, it is in this context furthermore preferable for the length of the inhomogeneity to make up a considerable portion of the length of the discharge lamp, at least a considerable portion of the length of the approximately parallel electrode profile. In this case, the major applications should be born in mind, in which the inhomogeneity - for monotonic variation of the maintaining voltage - extends over roughly the entire length of the parallel electrode profile, or over approximately half of it, in which case the other half may be chosen to have mirror-image symmetry. To this extent, length elements of at least one third, and preferably 40% or 45% of the length of the approximately parallel profile, are preferred.

BRIEF DESCRIPTION OF THE DRAWINGS

Specific exemplary embodiments of the invention will be explained in more detail in the following text with reference to the figures. These exemplary embodiments relate to the embodiment, which has already been described above, of the gas-discharge lamp according to the invention as a brake warning light for a motor vehicle. The individual features that are also disclosed in the course of the exemplary embodiments may also be significant to the invention in other combinations, or individually.

BEST MODE FOR CARRYING OUT THE INVENTION

Figure 1:
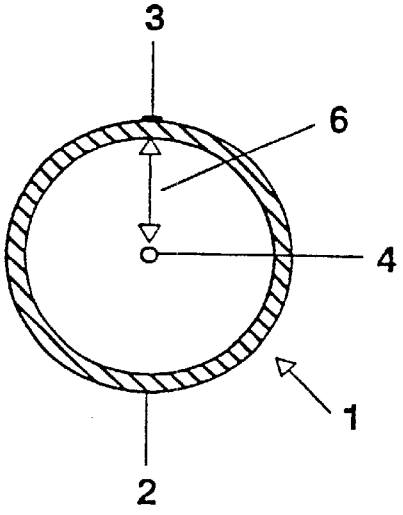
FIG. 1 shows a cross-sectional view, looking in the axial direction, through one model of a tubular gas-discharge lamp, to be precise on one edge of the lamp.
Figure 2:
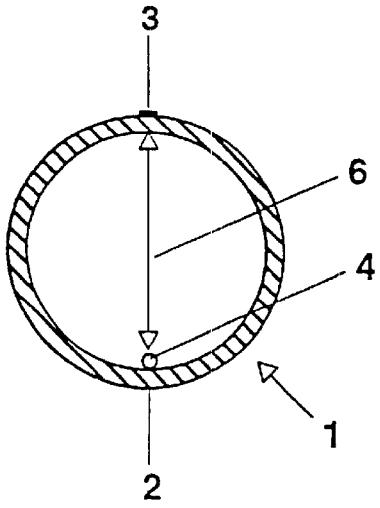
FIG. 2 shows a cross-sectional view corresponding to FIG. 1, but at the other edge of the tubular gas-discharge lamp.
Figure 3:
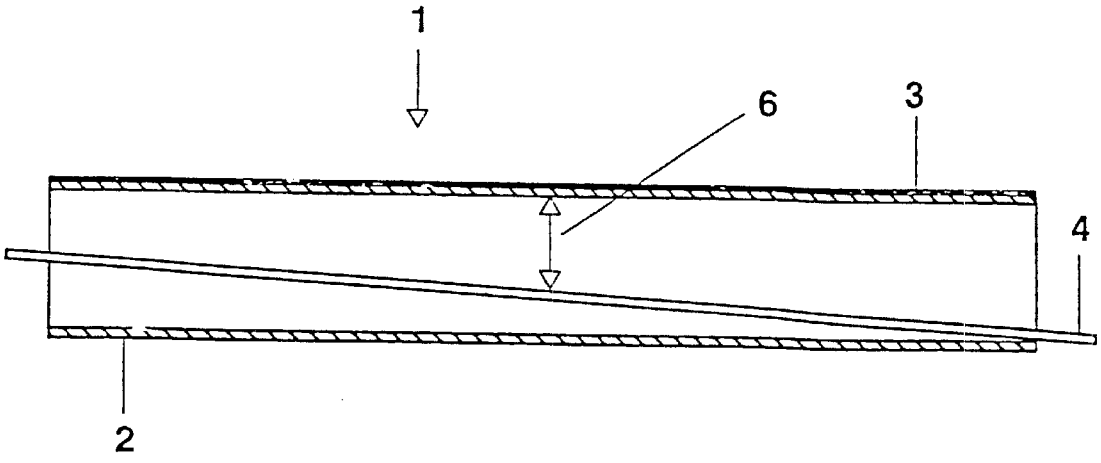
FIG. 3 shows a cross-sectional view of the gas-discharge lamp from FIGS. 1 and 2, but with the axial direction lying in the plane of the drawing, and FIG. 1 corresponding to the left-hand edge, and FIG. 2 corresponding to the right-hand edge, of the illustration in FIG. 3.

FIGS. 1–3 show, in simplified form, a model of a gas-discharge lamp to illustrate the principle of the invention. The electrical power supply for the lamp 1 and a fluorescent layer are not shown in this case.

The lamp 1 consists of a glass tube, whose length is illustrated in FIG. 3, as a discharge vessel 2 which is closed at both ends, that is to say at the left and right in FIG. 3. As can be seen from FIGS. 1 and 2, an anode strip 3 is in this case applied to the outer wall of the glass tube 2, so that the glass tube provides the dielectric barrier for the discharge. A cathode 4 is located inside the glass tube 2, to be precise centrally on the one edge of the glass tube 2 illustrated in FIG. 1—on the left in FIG. 3—and at the other edge—on the right in FIG. 3—on the inner wall face of the glass tube 2 opposite the anode 3. In this case, the cathode 4 is in the form of a straight wire, so that the discharge gap 6 between the cathode 4 and the anode 3 is varied linearly and monotonically over the length of the gas-discharge lamp 1.

In this model, the lamp length running transversely in FIG. 3 is 16 cm, and diameter of the tube is 2.5 cm, the thickness of the tube wall is 0.7 mm, and the gas filling consists of xenon at a pressure of approximately 130 mbar. The diameter of the cathode 4 is 1.5 mm. This results in the discharge gap 6 being varied from approximately 1.1 cm to approximately 2.2 cm.

With regard to the characteristics of such gas-discharge lamps with a dielectric barrier discharge, and to the pulsed real-power injection considered here, reference should be made to the following applications, included here as a supplement to the contents of the disclosures:

WO 94/23 442 and DE-P 43 11 197.1

WO 97/04 625 and DE 195 26 211.5

According to the invention, the length of the lamp occupied by the discharge structures can now be adjusted. As already mentioned, this can be done by varying various parameters relating to the electrical power supply. By way of example, two options are described here, to be precise variation of the pulse-repetition frequency and a variation of the voltage amplitude. In this case, all the other parameters relating to the electrical power supply are in each case kept constant, in particular the voltage waveform as well. The mean power varies, of course, corresponding to the variation of the varied parameter.

In this model example, the ratio between the length of the extent of the inhomogeneity (on the discharge gap variation) and the minimum discharge gap is more than 10.

Figure 4:
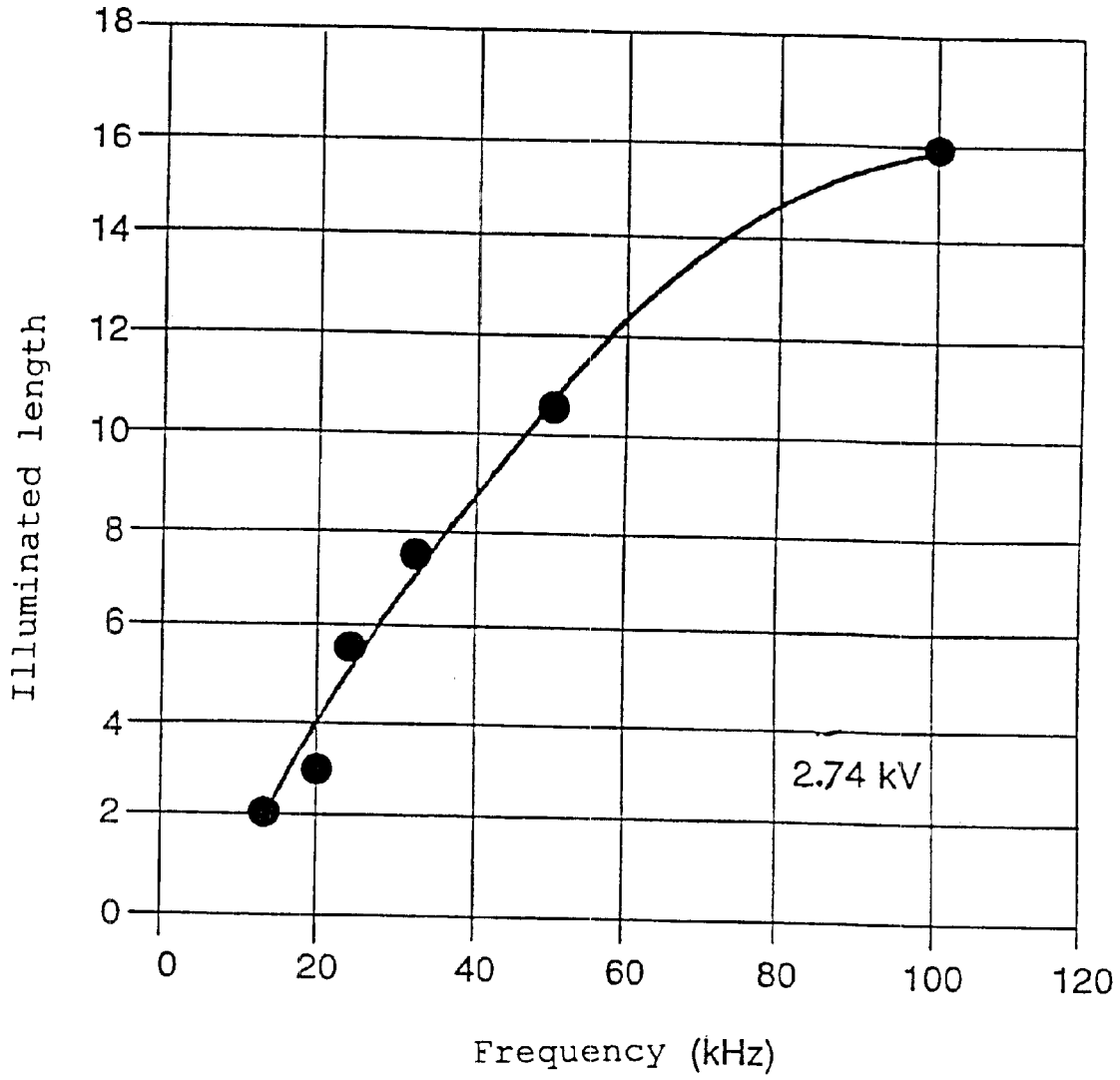
FIG. 4 shows experimental data relating to a variation of the illuminated length of the gas-discharge lamp illustrated in FIGS. 1–3 by variation of the operating frequency of a power supply.

FIG. 4 shows the measurement points of the illuminated length and the length of the tubular gas-discharge lamp 1 occupied by the discharge structures, as a function of the operating frequency or pulse-repetition frequency between approximately 17 kHz and 100 kHz. In this case, an illuminated length range of between 2 and 16 cm (full length) can be covered. It should be remembered that the line connecting the measurement points is not linear. In applications in which a linear relationship between the varied electrical parameter and the illuminated length is desirable, the position-dependency of the inhomogeneity, in this case the discharge gap 6, must therefore be adapted as appropriate in this exemplary embodiment.

Figure 5:
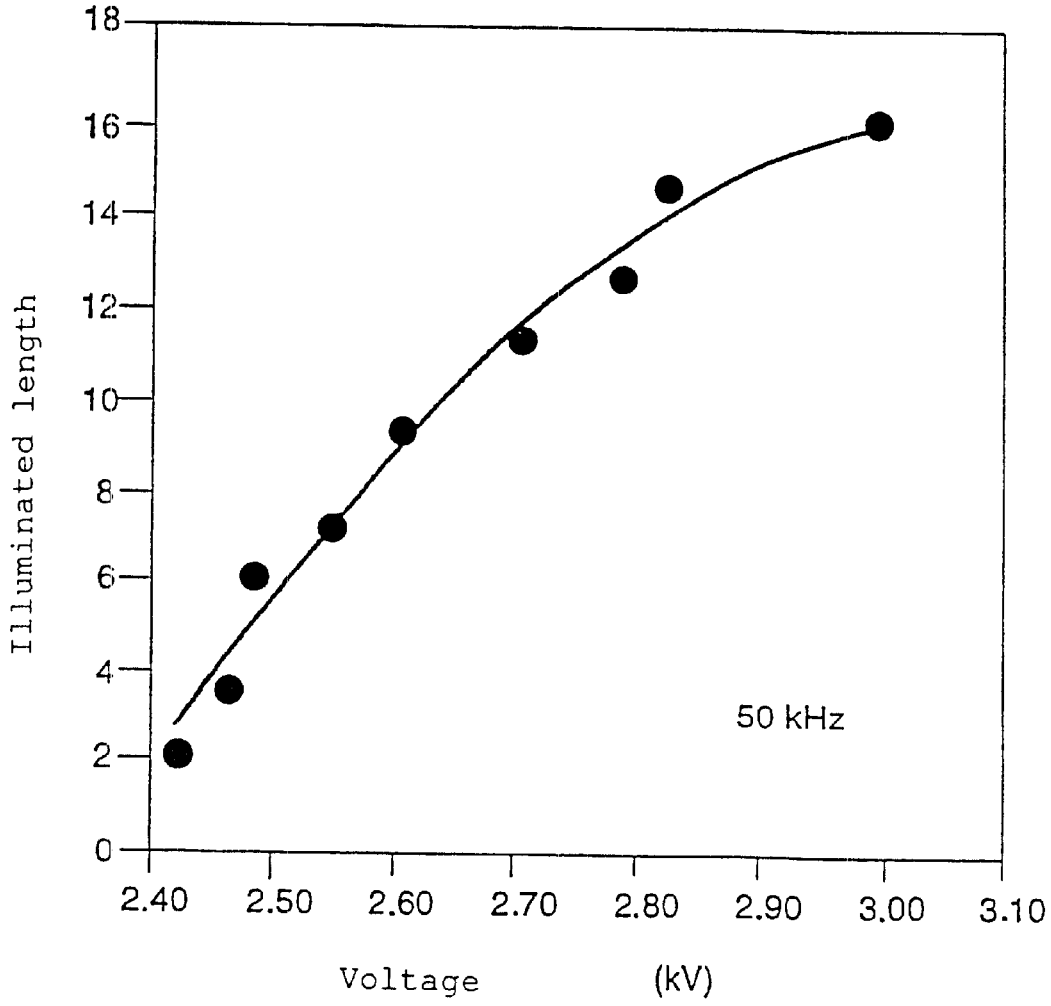
FIG. 5 shows a graph corresponding to FIG. 4, but with the voltage amplitude of the power supply being varied and the frequency being fixed.

This also applies to the example shown in FIG. 5, of variation of the voltage amplitude, with amplitude values between 2.44 and 3.02 kV.

Now that the basic principle of this invention has been explained on the basis of this model, a practical exemplary embodiment will now be added in the following text, in which analogous reference symbols denoted by a prime (') denote analogous components of the lamp.

Figure 6:
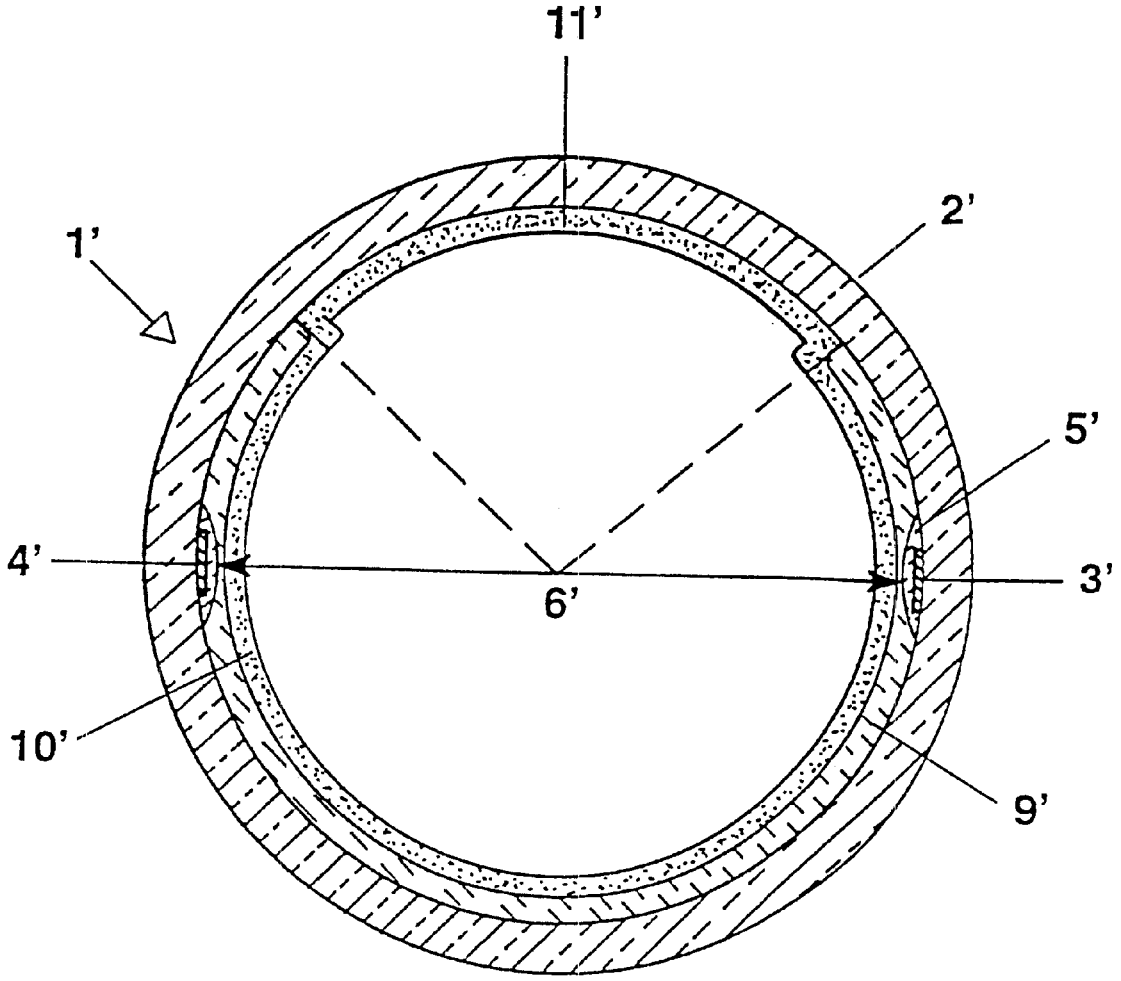
FIG. 6 shows a cross-sectional view, looking in the axial direction, through a tubular gas-discharge lamp for a brake warning light, to be precise at the edge of the lamp in the axial direction.

FIG. 6 shows a gas-discharge lamp according to the invention for a brake warning light. Brake warning lights are fitted to all vehicles licensed to use the roads. They are intended to inform traffic travelling behind that brakes have been operated, thus preventing rear-impact collisions. Rear-impact collisions have become more and more frequent recently, so that various attempts have been made to reinforce the warning function of brake warning lights. For example, additional brake warning lights have been used inside the rear screen in the interior of the vehicle, but these have not been generally adopted. Recently, additional brake warning lights centrally above the conventional outer brake warning lights have become virtually standard practice in new motor vehicles.

The prior art which has already been cited in the introduction already includes the basic idea of varying the physical extent of the illuminated area to provide a quantitative indication of the severity of the deceleration during braking. It has been found that, by virtue of this measure, the frequently hesitating braking of following traffic, before the seriousness of a hazard situation has been completely identified, can be avoided by extending the illuminated area of a brake warning light unusually and in an identifiable manner. Until now, a large number of individual lights, actuated separately, have been used for this purpose.

The novel gas-discharge lamp described here now allows a brake warning light to be designed having a variable illuminated area and, in particular, length in a single lamp and light which can be actuated in a standard manner. With regard to the design of the lamp, reference should initially be made to DE 19 718 395 C1. The disclosure content of this document is included here, by reference.

The gas-discharge lamp 1' whose cross section is illustrated in FIG. 6 is essentially a glass tube 2' with metal electrodes 3' and 4' deposited at opposite points on the inner wall. In the case shown here, the arrangement comprising the anode 3' and cathode 4' is symmetrical, that is to say it is also suitable for bipolar operation. In particular, all the electrodes 3' and 4' are deposited on the inner wall of the glass tube 2' in order to avoid the increase which would otherwise be required in the voltage from the power supply as a result of the considerable wall thickness of the glass tube 2'.

Figure 7:
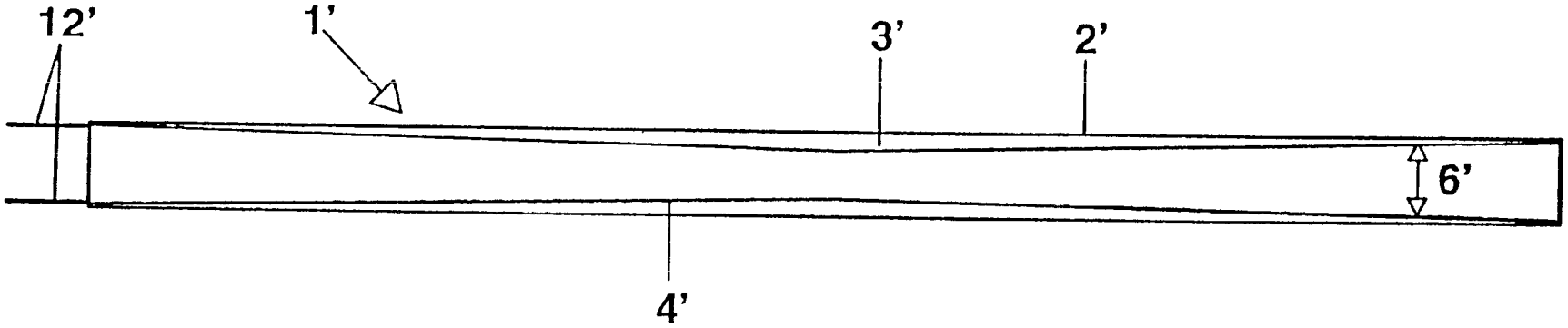
FIG. 7 shows a cross-sectional view of this gas-discharge lamp, with the axial direction lying in the plane of the drawing, to be precise looking in the same direction as in FIG. 1, seen from above.

The wall thickness of the glass tube 2' is approximately 1 mm, the external diameter of the lamp is approximately 10 mm. In this case, the length of the lamp which can be seen in FIG. 7 is approximately 1.5 m, and thus essentially covers the entire width of a normal motor vehicle. The length can, of course, be individually matched to different motor vehicle types.

The electrodes 3' and 4' are applied (using a pipette) to the inner surface of the glass tube 2' and consist of conductive silver paste; the dielectric 5' is likewise applied to the electrode strips 3' as a glass solder, to be precise after prior drying and heating of the electrodes. The flat reflective layer 9' and the flat fluorescent layer 10' are not applied using a pipette but by means of a flushing process, as is known from conventional fluorescent tube lamps. The electrodes are approximately 0.5–1 mm wide.

First of all, a reflective layer 9' is then deposited over the entire inner surface of the glass tube 2', with a fluorescent layer 10' being deposited over it, once the reflective coating 9' has been wiped off again in the region of an aperture 11', which can be seen in section in FIG. 6, with an opening angle of approximately 100°. The layers 3', 5', 9' and 10' are burned in successively.

The interior of the glass tube 2' is filled with xenon, as the gas filling, at approximately 100 torr (approximately 130 mbar=13 kPa). The technology of the xenon excimer discharge (which is preferably considered here) between dielectric barrier electrodes is known per se, and will not be described in any more detail. This produces short-wave VUV radiation. A major advantage of this discharge for the application being considered here is that the starting response is very fast, in contrast to conventional mercury discharges. The light generating characteristics of the lamp 1' do not significantly vary with temperature, in practice, so that it illuminates with the final intensity immediately when the electrical supply is started. In this context, and with regard to pulsed real-power injection as well, reference should be made to the disclosure content of the already cited applications, which is included here.

The electrodes 3' and 4' illustrated in section in FIG. 6 are routed to the exterior along a plug, which seals the glass tube 2', through a glass solder sealing layer at the left-hand end in FIG. 7, and end at external connections 12'. The way in which the electrodes are passed through to external connections 12' is particularly simple from the production engineering point of view, and is described in detail in the already cited DE 19 718 395 C1. The glass tube is designed to be closed at the opposite end.

FIG. 6 shows the discharge gap 6' between the opposite electrodes 3' and 4'. This gap is slightly smaller than the internal diameter of the glass tube, and is thus just about 8 mm. The cross-sectional view in FIG. 7 shows that this discharge gap varies along the axial length of the glass tube 2'. This is achieved by continuously varying the position of the electrodes 3', 4' on exactly opposite sides of the inner envelope surface of the glass tube 2' at the respective outermost edge, as shown in FIG. 6, further downwards in the center region of the glass tube 2'. The continuous transition between them results in the discharge gap 6' being monotonically increasingly dependent on the position, outwards to the right and left, from the center of the gas-discharge lamp 1'. The thickness of the dielectric 5' is approximately constant in this case.

This position-dependency of the discharge gap 6' corresponds to position-dependency of the minimum maintaining voltage for the discharges. In the case of the "smooth" electrodes 3' and 4' envisaged here, discharges in the central region can start, in the manner already discussed, with a very small discharge gap 6', and these discharges can then move towards both outer edges, depending on the available supply voltage. This results in the centered illuminated length of the gas-discharge lamp 1' having a variable length, whose advantages have already been referred to further above.

In this case, the discharges burn in the direction of the discharge gap 6' shown in FIG. 6, that is to say in the direction of the diameter. The light emitted in the direction of the aperture 11', which is central about the vertical center line of the discharges, is thus a maximum. This is due to the fact that the greatest proportion of the light is in each case produced in the fluorescent layer 10' centrally on the side of the inner wall of the glass tube 2' opposite the aperture 11 ' and in the region of the aperture 11', and is partially reflected by the reflective layer 9'.

Figure 8:
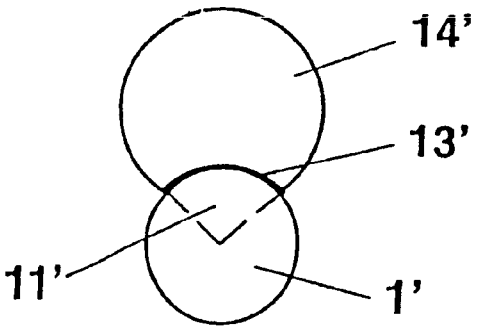
FIG. 8 shows a schematic illustration, in the same perspective as FIG. 6, in which the gas-discharge lamp is combined with a lens.

As can be seen in FIG. 8, a filter 13' is provided over the aperture 11'. This filter 13' is used to set the red spectral locus of the brake warning light 1' to comply with the relevant standards.

A plexiglass lens 14' arranged above this has the task of more strongly focusing the beam angle (which lies in the plane of the drawing in FIG. 6) of the light which is essentially emitted diffusely from the lamp 1' and thus of making it stronger for traffic travelling behind. Films could also be used for this purpose, for example prismatic films (so-called brightness enhancement films manufactured by 3M), holographic films or Fresnel films.

Figure 9:
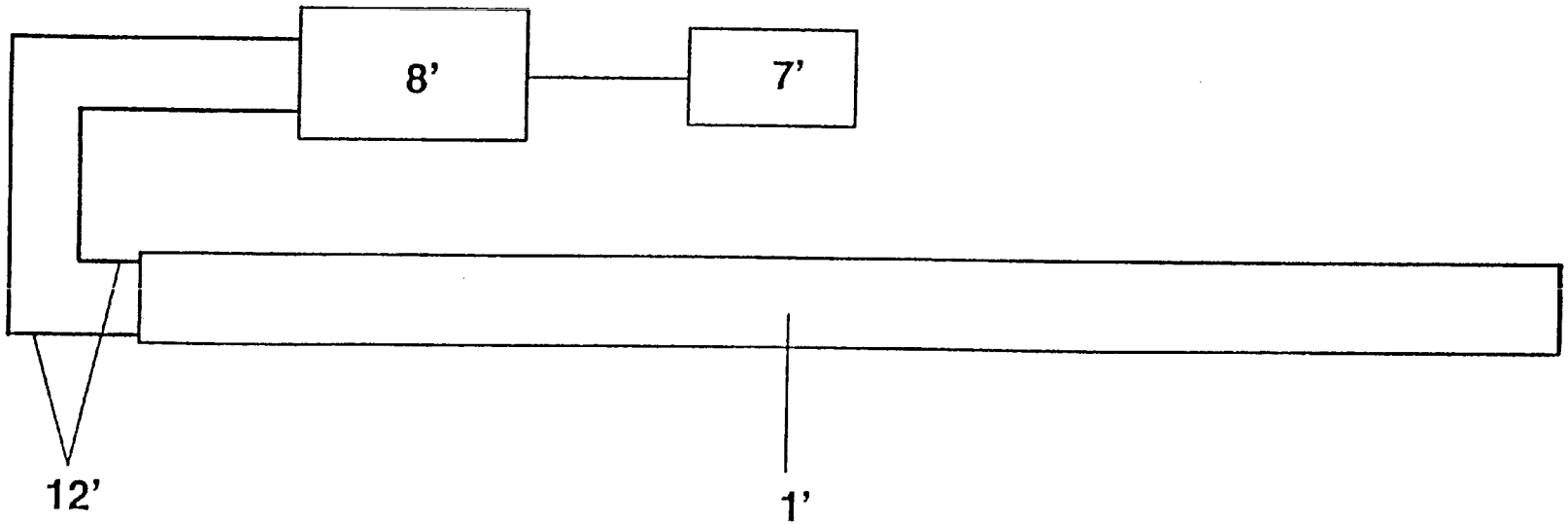
FIG. 9 shows a schematic illustration of an apparatus for indicating a braking deceleration having a braking deceleration sensor and a control unit as well as the brake warning light from FIG. 8.

FIG. 9 shows, schematically, a supply for the already described lamp 1', at its external connections 12' (which are also shown in FIG. 7) for the electrodes, via a control unit 8', which is actuated by a deceleration sensor 7'. The detailed technical design of this control unit 8' and of the deceleration sensor 7' will not be described in detail here. These are conventional technical solutions, which are well known by a person skilled in the art. With regard to the pulsed power supply by the control unit 8', reference should also be made to German Applications 19839329.6 and 19839336.9 dated 28.8.1998, from the same applicant.

With regard to the lamp barrier on both sides in FIG. 6, it should be mentioned at this point that the bipolar method of operation is particularly suitable for the electrodes shown there, which are identical in terms of physical discharge aspects. In this case, the electrodes carry out the role of both a temporary anode and a temporary cathode, alternately in time.

One advantage of the bipolar method of operation may be, for example, that the discharge conditions in the lamp are made symmetrical. Problems caused by asymmetric discharge conditions are thus particularly effectively avoided, for example ion migration in the dielectric, which can lead to blackening or to space-charge accumulations, which reduce the efficiency of the discharge.

The deceleration sensor 7' is a dynamic deceleration sensor, as is known, for example, for the triggering of air bag systems in the automobile field.

Further possible design variants from the exemplary embodiment described here may include the already mentioned projections, in order to make it easier for discharges to start. A thicker dielectric covering can in this case preferably be provided on the projections, in order to prevent arc formation.

It is also possible to omit the dielectric on the cathode for unipolar operation. However, in order to prevent sputtering erosion of the cathode material, this may be worthwhile even for unipolar operation, preferably with a reduced thickness (in the order of magnitude of 20 θm in comparison with being in the order of magnitude of 200 θm on the anode).

As already described in the introduction to the description, the thickness of the anode dielectric may also be varied, in order to create the inhomogeneity required for the position-dependency of the discharge voltage. In addition, it is also possible to vary the thickness of the anode dielectric over the length of the lamp 1 so that an essentially homogenous light intensity can be achieved over the illuminated length of the lamp, despite the variable discharge gap 6'. The same applies to the width of the anode strips 3', which has likewise already been mentioned. In this case, the respective influence on the position dependency (according to the invention) of a maintaining voltage must be more than compensated for in some other way, for example via the electrode gap 6'.

What is claimed is:

1. A gas-discharge lamp (1) comprising a discharge vessel (2, 2') filled with a gas filling, having at least one anode electrode (3, 3') in the form of a strip, and having at least one cathode electrode (4, 4') in the form of a strip, which, at least in a place, are arranged essentially parallel to one another along a length, and having a dielectric layer (5') between at least the anode (3, 3') and the gas filling, wherein along at least the place where the anode and cathode electrodes are essentially parallel, the anode and cathode electrode arrangement (3, 3'4, 4') is at least partially inhomogeneous along the length in a form that varies a maintaining voltage.

2. A gas-discharge lamp (1) comprising a discharge vessel (2, 2') filled with a gas filling, having at least one anode electrode (3, 3') in the form of a strip, and having at least one cathode electrode (4, 4') in the form of a strip, which, at least in a place, are arranged essentially parallel to one another along a length, and having a dielectric layer (5') between at least the anode (3, 3') and the gas filling, wherein along at least the place where the anode and cathode electrodes are essentially parallel, the anode and cathode electrode arrangement (3, 3'4, 4') is at least partially inhomogeneous along the length in a form that varies a maintaining voltage in which the inhomogeneity comprises a change in the discharge gap (6, 6') between the electrodes (3, 3', 4, 4').

3. The gas-discharge lamp (1) according to claim 2, in which the electrodes (3, 4) have projections for physical localization of individual discharges, which define respective discharge gaps.

4. A gas-discharge lamp (1) comprising a discharge vessel (2, 2') filled with a gas filling, having at least one anode electrode (3, 3') in the form of a strip, and having at least one cathode electrode (4, 4') in the form of a strip, which, at least in a place, are arranged essentially parallel to one another along a length, and having a dielectric layer (5') between at least the anode (3, 3') and the gas filling, wherein along at least the place where the anode and cathode electrodes are essentially parallel, the anode and cathode electrode arrangement (3, 3', 4, 4') is at least partially inhomogeneous along the length in a form that varies a maintaining voltage in which the inhomogeneity comprises a change in the anode width.

5. The gas-discharge lamp (1) according to claim 1, in which the inhomogeneity comprises a change in the thickness of the dielectric layer (5).

6. The gas-discharge lamp (1, 1') according to claim 1 as a bar display device, in which the discharge vessel (2, 2') has an elongated form, and the electrode arrangement (3, 3', 4, 4') and the inhomogeneity extends along at least a part of the elongated form.

7. A gas-discharge lamp (1) comprising a discharge vessel (2, 2') filled with a gas filling, having at least one anode electrode (3, 3') in the form of a strip, and having at least one cathode electrode (4, 4') in the form of a strip, which, at least in a place, are arranged essentially parallel to one another along a length, and having a dielectric layer (5') between at least the anode (3, 3') and the gas filling, wherein along at least the place where the anode and cathode electrodes are essentially parallel, the anode and cathode electrode arrangement (3, 3', 4, 4') is at least partially inhomogeneous along the length in a form that varies a maintaining voltage in which the length of the extent of the inhomogeneity is at least twice a minimum discharge gap (6, 6') between the electrodes (3, 3', 4, 4').

8. A gas-discharge lamp (1) comprising a discharge vessel (2, 2') filled with a gas filling, having at least one anode electrode (3, 3') in the form of a strip, and having at least one cathode electrode (4, 4') in the form of a strip, which, at least in a place, are arranged essentially parallel to one another along a length, and having a dielectric layer (5') between at least the anode (3, 3') and the gas filling, wherein along at least the place where the anode and cathode electrodes are essentially parallel, the anode and cathode electrode arrangement (3, 3', 4, 4') is at least partially inhomogeneous along the length in a form that varies a maintaining voltage in which the inhomogeneity extends in a monotonic manner along at least one third of the overall length of the essentially parallel profile of the electrodes (3, 3', 4, 4'), which are in the form of strips.

9. The gas-discharge lamp (1, 1') according to claim 1 in which the discharge vessel (2, 2') has a tubular shape.

10. The gas-discharge lamp (1') according to claim 1 which is in the form of a brake warning light for a motor vehicle or two-wheeled vehicle.

11. The gas-discharge lamp (1, 1') according to claim 7 in which the length of the extent of the inhomogeneity is at least five times a minimum discharge gap (6, 6') between the electrodes (3, 3', 4, 4').

* * * * *